US005498443A

United States Patent [19]

Sobol

[11] Patent Number: 5,498,443

[45] Date of Patent: Mar. 12, 1996

[54] PARTICLE LOADING OF FLEXIBLE THREE-DIMENSIONAL NON-WOVEN FABRICS

[76] Inventor: Thomas J. Sobol, 23800 Albers, Woodland Hills, Calif. 91364

[21] Appl. No.: 280,779

[22] Filed: Jul. 26, 1994

[51] Int. Cl.[6] ..... B05D 5/12

[52] U.S. Cl. ..... 427/122; 156/84; 156/219; 156/227; 156/278; 156/279; 156/280; 156/293; 156/306.6; 427/58; 427/123; 427/170; 427/209; 427/366; 427/385.5; 427/389.9; 427/394

[58] Field of Search ..... 427/58, 122, 170, 427/123, 209, 385.5, 389.9, 394, 366; 156/279, 280, 293, 306.6, 84, 219, 227, 278

*Primary Examiner*—Bernard Pianalto
*Attorney, Agent, or Firm*—Beehler & Pavitt

[57] ABSTRACT

A non-woven fabric consisting of random entangled staple fibers which serves as a supporting structure is first subjected to pressure spraying on each side with a paint-like liquid comprised of a water base, or of a petroleum solvent thinner containing micron sized particles, such as copper treated with a suitable compatible binder, such as polyester epoxy, or acrylic resins. After spraying and drying, all solvents are removed by air circulating in an oven. The thus-sprayed fabric is then passed through apparatus which simultaneously heats and compresses the fabric to greatly reduce its thickness to form a sheet in which the entrained metal particles are brought into intimate contact with each other, thereby to impart conductivity to the fabric sheet.

8 Claims, 2 Drawing Sheets

Fig. 1
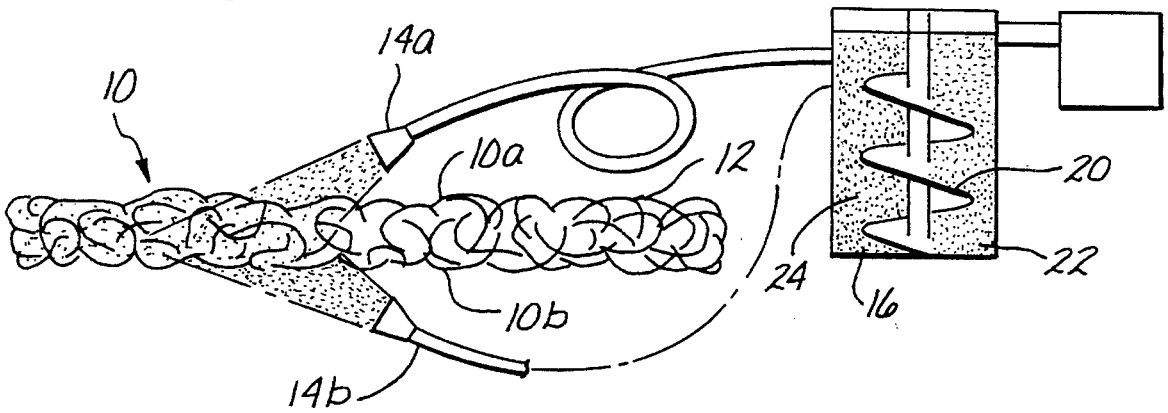
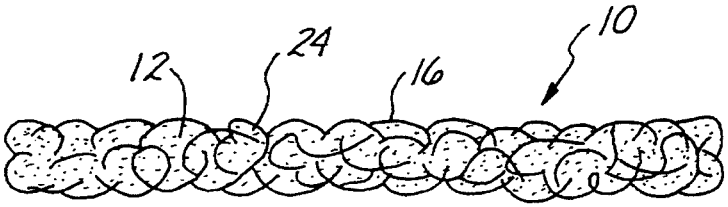
Fig. 2
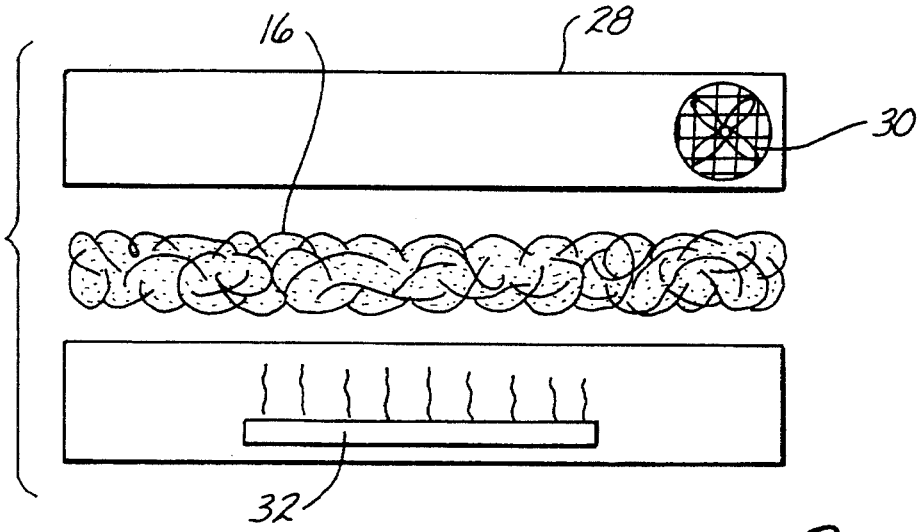
Fig. 3

PARTICLE LOADING OF FLEXIBLE THREE-DIMENSIONAL NON-WOVEN FABRICS

FIELD OF THE INVENTION

This invention relates generally to the field of the manufacture of fabrics and, particularly, to the preparation of conductive fabrics of the non-woven type.

BACKGROUND OF THE INVENTION

1. Description of the Prior Art

In recent years a considerable demand has developed for flexible fabrics having conductive properties for such uses as EMI shielding, static interception and general electrical conduction. Heretofore, conductive fabrics have been prepared by several processes such as electro plating, vapor deposition, electron beam deposition and magnetron sputtering. While each of these processes may be particularly effective for developing an electrically conductive surface on different types of articles, including fabrics, the cost of preparing an electrically conductive fabric, by even the most efficient of these prior art methods, is quite high, i.e. of the order of $15.00 per square foot. Such high cost tends to limit the use of conductive fabrics to applications where such fabrics are absolutely necessary. In such applications where many square yards of fabric are required, such as in a tent, the high cost of producing an electrically conductive fabric constitutes a matter of important economic concern.

What has been needed, therefore, is some method of producing an electrically conductive fabric at a substantially lesser cost than is possible with any of the prior art methods.

SUMMARY OF THE INVENTION

The present invention utilizes as its supporting structure a non-woven fabric that consists of random staple fibers entangled to form a strong fabric like three-dimensional structure. The fabric is first subjected to spraying from each side by a pressure spray gun of a paint- like liquid. This liquid is comprised of a water base, or of a petroleum based solvent thinner, containing micron sized particles, such as copper treated with a suitable compatible binder such as polyester, epoxy or acrylic resins. At the time of spraying, the liquid is agitated to prevent any settling of the metallic particles at the bottom of the container holding the liquid. A conventional air spray gun or high volume low pressure air gun may be employed to coat the staple fibers in the three dimensional fabric structure. The metallic particles deposited on the fabric fibers may be varied in density by the amount of liquid which is sprayed to produce the desired amount of conductivity for the final product. After spraying both sides of the fabric, the latter may be allowed to dry at room temperature for an appropriate period, e.g. one hour, and is then conditioned for an additional period in an air circulating oven to remove all solvents and low volatile particles. Thereafter, the fabric is passed through apparatus for simultaneously heating and compressing sheet material, such as that known as a rotorcure where heat and pressure are simultaneously provided for a brief period in order to compress the fabric and greatly reduce its thickness. This results in bringing the metallic particles into intimate contact with each other, thereby to provide excellent conductivity for the fabric. A fabric so prepared is conductive, flexible and can be sewn die-cut, clamped or draped in the manner of most non-conductive fabrics. The cost of producing a conductive fabric according to the present invention may be as low as $3.00 per square foot as compared to the $15.00 per square foot cost by prior art methods.

DESCRIPTION OF THE DRAWINGS

In the accompanying drawings,

FIG. 1 illustrates the spraying of a non-woven fabric in accordance with the present invention.

FIG. 2 shows the result of the spraying and disposition of the sprayed fabric for its initial drying.

FIG. 3 shows the second drying step.

DESCRIPTION OF THE PREFERRED EMBODIMENT

Figure 4:
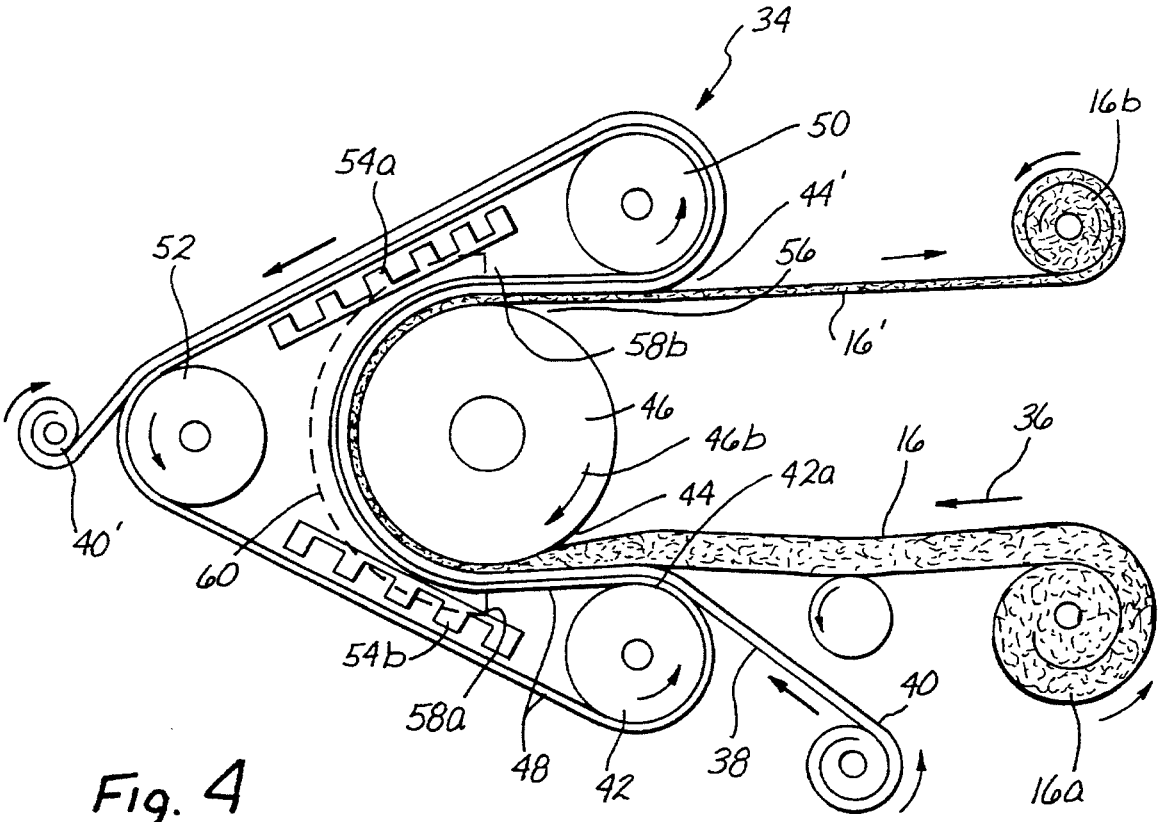
FIG. 4 illustrates schematically the manner in which the dried fabric is subject to heat and compression in a rotocure apparatus.

Referring to FIG. 1 of the drawings, a non-woven fabric 10 consisting of random staple fibers 12 entangled to form the three dimensional structure is shown generally as 10. Both sides 10*a* and 10*b* of the fabric 10 are subjected to spraying either simultaneously by two spray guns 14*a* or 14*b*, or by a single gun 14*a* moved from one side 10*a* after its spraying to side 10*b*, with a paint-like liquid 16 from a container 18 having a motor driven agitator 12. The liquid 16 may be comprised of a water base or petroleum based solvent 22 in which are dispersed countless metallic particles 24 treated with a suitable compatible binder, such as polyester, epoxy or acrylic resins. Before spraying occurs, the agitator 20 is operated in the liquid 16 to ensure that the metallic particles 24 are evenly dispersed throughout the liquid 22. When so dispersed, the liquid may be conducted by hoses 26*a* and 26*b* to the spray guns 14*a*, 14*b* respectively. The spray guns 14*a* and 14*b* may either be conventional air spray guns or high volume low pressure air guns. The spray guns 14*a* and 14*b* are moved across the fabric 10 to fairly well saturate the fabric, depending upon the extent of conductivity which is desired for the final product.

After spraying has been completed, the fabric 10 will appear as shown in FIG. 2 with each of its fibers 12 completely coated with the liquid 16 and its entrained metallic particles 24 so that the latter are attached to each of the individual fibers 16.

After a period of approximately one hour, during which the coated fabric 10 is dried at room temperature, the fabric is then placed in an air circulating oven 28 which is provided with a blower 30 and a heater 32. The fabric 16 is then left in this air circulating oven 28 for sufficient period, e.g. one hour, to effect the removal of all solvents and low volatile particles.

Upon completion of the drying of the fabric 16 in the oven 28, it is then rolled up in a form 16*a* for submission to heat and pressure in an apparatus, such as a rotocure 34, which is shown schematically in side view in FIG. 4. Such rotocure apparatus was originally made and sold by the Boston Woven Hose Company as far back as 1939 and subsequently by Farrell Manufacturing Co. of Ansonia, Conn. In this apparatus, the tape 16 is unrolled from 16*a* and moved in the direction of the arrow 36 to join a pressure pad 38 which is simultaneously being unrolled at 40. The fabric 16 and the pressure pad 38 are passed over the roll 42 into the bite 44 between the large drum 46 and the steel band 48 which is continuously moved over the drum 46 in a closed loop circuit which extends about the rollers 50, 52 and 42. The heater 54*a* is disposed between the rollers 50 and 52 and a corresponding heater 54*b* is located between the rollers 52 and 42. In addition, the large drum 46 may be steam heated to a temperature of 300 degrees.

In this rotocure arrangement, with the pressure pad 38 combined with the fabric 16 from the roll 16*a* as both arrive at the top 42*a* of the roller 42 and enter the bite 44 between the steel band 48 and the outer surface 46*a* of the drum 46, they are compressed between the steel band 48 and the drum surface 46*a* as the drum 46 turns in the direction of the arrow 46*b* over the dotted arcuate path 60 between the points 58*a* and 58*b*. Thereby, the fabric 16 is compressed from its three dimensional size shown in FIG. 2, to the much thinner cross sectional configuration 16' shown in FIG. 5. This compressed fabric 16' then moves in the direction of the arrow 36' to become the roll 16*b*. It will be noted that, as the combined fabric 16 and pressure pad 38 arrive at the roller 50, they are separated at 44' where the pad 38 passes over the roll 50 to the pressure pad roll up 40'.

Figure 5:
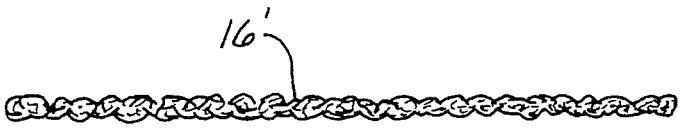
FIG. 5 shows a sectional view of the resulting electrically conductive compressed fabric.

It should be understood that the rotocure apparatus itself is not a part of the present invention, but has been found to be effective in compressing the three dimensional fabric 10 shown in FIG. 2 to the flattened state 16', shown in FIG. 5. However, any other apparatus for processing sheet material while simultaneously applying heat and pressure to such material for the desired time period could also be used.

The foregoing describes the method of the present invention as it might be generally practiced. Specific examples are as follows:

Example No. 1

A Spraylat series 599, paint style 599-Y1325 flexible copper conductive coating is sprayed onto a Sontara spunlaced fabric style 80100 merged polyester staples, 0.030" thick by using a conventional air spray gun with high pressure air. The Spraylat series 599 coating is offered by the Spraylat Corporation of 716 So. Columbus Avenue, Mt. Vernon, N.Y. 10550. The container 18 for the 599 copper paint should be constantly agitated to ensure uniform distribution of the copper particles in the paint. After the spray painting on each side 10*a*, 10*b* to ensure penetration with the innermost staple fibers 12, the fabric 10 is allowed to dry for one hour at room temperature. After such drying, the fabric 10 is placed in an air circulating oven 28 for one hour to remove all remaining solvents and low volatile particles. Following such drying the fabric is passed through the rotocure 34 for simultaneous application of heat and pressure for approximately five minutes. The Sontara utilized is a product of the Dupont Company produced and sold from its facility in Old Victory, Tenn. Following the subjection to heat and pressure through the rotocure, the three dimensional fabric 16 was collapsed to a thickness of 0.012" which represented a 60% reduction in the fabric's thickness. This collapse brought the metal particles into intimate contact with each other to provide excellent conductivity on each side of the fabric and through the fabric.

Example 2

The same procedure is followed as in Example 1, except that a Spraylat series paint style 599-Y1062 flexible carbon coating was sprayed onto the Sontara unlaced fabric style 8100 merged polyester staples.

Example 3

The same procedure was followed as in Example 1, except that the Spraylat paint 599-Y1325 flexible copper conductive coating was sprayed on only one side of the Sontara spun lace fabric.

Example 4

The Spraylat paint 599-Y-1325 flexible copper conductive coating was sprayed on one side of the Sontara spun lace fabric 10 and oven dried as in Example 3. The fabric was then doubled in thickness by placing uncoated sides back-to-back with an insert of 0.001" thick polyurethane between the fabrics. This fabric sandwich was then passed through the rotocure for five minutes at 280 degrees Fahrenheit and 500 psi pressure. Thereby, a fabric was produced which was conductive on both sides, but not through the fabric.

The method of the present invention may thus be applied in a number of ways and with different types of materials to produce fabrics of various conductive qualities and at a relatively low cost as compared with conductive fabrics produced by prior art methods.

I claim:

1. The method of fabricating a flexible conductive fabric, said method comprising the steps of:

a) applying by a spray gun to at least one side of a non-woven fabric consisting of entangled staple fibers a metallic conductive coating in which micro sized metallic particles are entrained in a liquid carrier comprising a solvent with a compatible binder, thereby to constitute low volatile particles;

b) allowing the sprayed fabric to dry at room temperature for approximately one hour;

c) conditioning the sprayed fabric in an air circulating over for an additional period of approximately one hour to ensure the removal of all solvent and low volatile particles; and d) passing the fabric through a rotocure to apply simultaneously heat of approximately 280 degrees and pressure in the order of 500 psi to the sprayed and dried fabric for a period in the order of five minutes to collapse the fabric to greatly reduce its thickness and to bring the metallic particles of the conductive coating applied to the fabric into intimate contact with each other, thereby to render the coated fabric conductive.

2. The method as described in claim 1 wherein the metallic coating is applied to both sides of the fabric.

3. The method as described in claim 1 wherein the metallic coating is a flexible copper coating.

4. The method as described in claim 1 wherein the metallic coating is a flexible carbon coating.

5. The method as described in claim 1 wherein the metallic coating is a composition of a petroleum based solvent thinner, containing micron sized conductive particles, treated with a polyester resin binder.

6. The method as described in claim 1 wherein the metallic coating is a composition of a water base containing micron sized conductive particles, treated with a binder of polyester resin.

7. The method as described in claim 1 wherein the fabric is a spun laced textile material composed of staple fibers entangled through hydraulic needling.

8. The method as described in claim 1 wherein the conductive coating is applied to only one side of the fabric; after the sprayed fabric is conditioned in the oven to ensure removal of the solvent and low volatile particles, the fabric is folded over to place its uncoated sides back-to-back and between them is sandwiched a polyester urethane film of a thickness of the order of 0.001"; and the fabric sandwich is then passed through the rotocure for said five (5) minute period, to produce a fabric which is conductive on both sides, but non-conductive between said sides.

* * * * *